US009497995B2

(12) United States Patent
Liu

(10) Patent No.: US 9,497,995 B2
(45) Date of Patent: Nov. 22, 2016

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 375 days.

(21) Appl. No.: 14/027,870

(22) Filed: Sep. 16, 2013

(65) Prior Publication Data

US 2014/0366897 A1 Dec. 18, 2014

Related U.S. Application Data

(63) Continuation of application No. PCT/CN2013/077280, filed on Jun. 14, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 40/542
See application file for complete search history.

(56) References Cited

U.S. PATENT DOCUMENTS 1,346,360 A * 7/1920 White ..... F21K 2/00 33/293
2,340,227 A * 1/1944 Russell ..... B29C 39/12 101/32
2,921,587 A * 1/1960 Cordeiro, Jr. ..... A24D 1/04 131/362
6,074,739 A * 6/2000 Katagiri ..... C09K 11/02 428/207
2002/0019312 A1* 2/2002 Ramsden ..... B41M 5/035 503/227
2010/0200006 A1* 8/2010 Robinson ..... A24F 47/008 131/194
2013/0015759 A1* 1/2013 Chiang ..... C04B 35/195 313/498
2013/0056013 A1* 3/2013 Terry ..... A24F 47/008 131/328
2013/0180139 A1* 7/2013 Underwood ..... G09F 13/20 40/543
2013/0228190 A1* 9/2013 Weiss ..... A24F 47/002 131/328
2013/0312742 A1* 11/2013 Monsees ..... A61M 15/06 128/202.21
2014/0055049 A1* 2/2014 Shao ..... H01L 33/62 315/192
2014/0230835 A1* 8/2014 Saliman ..... A24F 47/008 131/329
2015/0034106 A1* 2/2015 Liu ..... A24F 47/008 131/329
2015/0090274 A1* 4/2015 Polloni ..... A24D 1/00 131/76

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

This application relates to an electronic cigarette, comprising a cigarette body, wherein, emitting materials which can emit light in the dark are configured on the cigarette body. The electronic cigarette of the application can fulfill users' need of a quick reach to the electronic cigarette in the dark, thus enormously increasing users' experience.

1 Claim, 3 Drawing Sheets

ELECTRONIC CIGARETTE

CROSS-REFERENCE TO RELATED APPLICATIONS

This application is a continuation of International Patent Application No. PCT/CN2013/077280, with an international filing date of Jun. 14, 2013, designating the United States, now pending. The contents of these specifications are incorporated herein by reference.

FIELD OF THE INVENTION

This application relates to the field of electronic heated product, and more particularly to an electronic cigarette.

BACKGROUND OF THE APPLICATION

Electronic cigarettes, as replacement of the traditional cigarette, enjoy a wide market prospect. However, some consumers have a habit of smoking in the night, the present electronic cigarette cannot satisfy those consumers to swift get the electronic cigarette in the dark, and thus the present electronic cigarette has a poor customer experience.

SUMMARY OF THE APPLICATION

The technical problem to solve in the application is to deal with the defects in the prior art that consumer's need for swift finding the electronic cigarette in the dark cannot be satisfied at present, and this application provides an electronic cigarette which can emit light.

In one aspect of the application, an electronic cigarette is provided. The electronic cigarette comprises a cigarette body, wherein emitting materials which can emit light in the dark are configured on the cigarette body.

In the aspect of the application, the emitting material is a noctilucent material and/or fluorescent material. A transparent layer is mounted on the emitting layer; the transparent layer used for light transmission is resin. The emitting layer is provided with a thickness of $10\text{-}2\times10^3$ μm. The emitting layer is formed by way of screen printing, steaming plating, splashing plating, coating or attaching.

In one embodiment of the of the application, a suction mouth lid is mounted at an end of the cigarette body, a light cap is mounted at the other end, far away from the suction mouth lip, of the cigarette body, and the emitting material is configured on the outer surface of the light cap. The light cap is made of the emitting material. An emitting layer formed by the emitting material is mounted on outer surface of the light cap. There may be an attaching layer between the emitting layer and the light cap, and the emitting layer is attached on the light cap by the attaching layer. The emitting material is fused on the light cap. The emitting material may be embedded into the light cap.

In another embodiment of the application, a paster is attached to the outer surface of the cigarette body, and the emitting material is mounted on the surface of the paster. The paster comprises a back glue layer and an emitting layer made of the emitting material on above of the back glue layer. Figures or characters are formed by the emitting material on the surface of the plaster.

In a further embodiment of the application, on the surface of the cigarette body, there is a switch region for controlling the electronic connection between the atomizing assembly and the battery assembly, and the emitting material is mounted on the surface of the switching region or around the switching region. Figures or characters are formed by the emitting material on the surface of the switching key.

The switching region is a touch sensing region or a switching key. A switching base is mounted in the cigarette body corresponding to the switching key, the switching base is mounted on a PCB board separately connected to the atomizing assembly and the battery assembly, and the switching base is configured for transmitting the press signal from the switching key to the PCB board, thus the PCB board controls the electronic connection between the atomizing assembly and the battery assembly.

In an additional embodiment of the application, the cigarette body comprises a covering envelope which forms a cystid for receiving the emitting material.

The covering envelope is attached on the light cap.

By implementing the electronic cigarette of the present application, following advantages may be obtained: With the emitting material attached on surfaces of the light cap or the cigarette rod, users can also exotically and conveniently reach to the electronic cigarette in the application, and thus the user experience can be increased. Besides, the noctilucent material or fluorescent material configured on or around the switching key can indicate the position of the key, enabling users' smoking operation in the dark.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

To make the objective, technical solution and advantages of the application more clearly understood, the application is to be further described with reference to the accompanying drawings and embodiments. It should be acknowledged that the embodiments are configured to interpret the application, and shall not be construed as limiting the application.

This application relates to an electronic cigarette, comprising a cigarette body 2, an end of the cigarette body 2 is configured a suction mouth lid 1, and emitting materials which can emit light in the dark are configured on the cigarette body 2. The emitting material in this application comprises noctilucent material and/or fluorescent material, and herein the noctilucent material can be Self-luminous or light-retaining material, such as noctilucent powder or fluorescent powder which can retain light and emit light along with absorbing the ultraviolet. With the light emitted by the emitting material, users can reach to the electronic cigarette exactly and swift at night or in the dark.

First Embodiment

Figure 1:
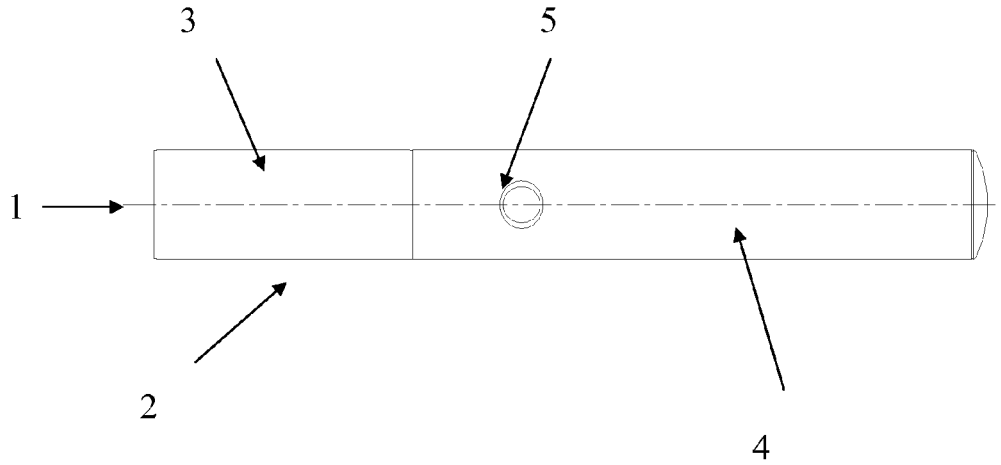
FIG. 1 illustrates a structure view of the electronic cigarette in accordance with a first preferable embodiment of the present application.
Figure 2:
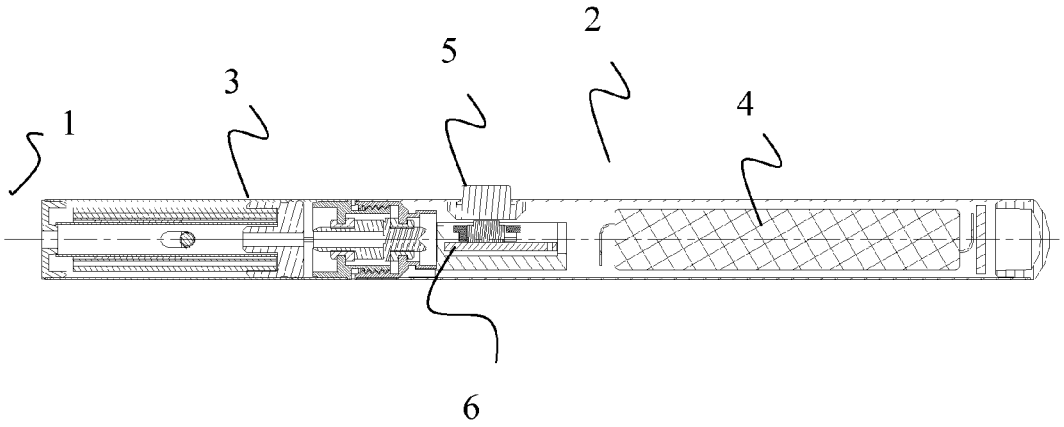
FIG. 2 illustrates a cutaway view of the electronic cigarette in FIG. 1.

Referring to FIG. 1 to FIG. 2, the first preferable embodiment of the present application relates to an electronic cigarette, comprising a cigarette body 2. A suction mouth lid 1 is configured on an end of the cigarette body 2, and an atomizing assembly 3 and a battery assembly 4 are housed in the cigarette body 2. In this embodiment, on the surface of the cigarette body 2, a switching region 5 is configured for controlling the electronic connection between the atomizing assembly 3 and the battery assembly 4. The switching region 5 may be a touch sensing region or a switching key. As shown in FIG. 1, the switching region 5 is a switching key projecting from the cigarette body 2.

The noctilucent material or fluorescent material is configured on or around the switching key, therefore, except that it is convenient for users to reach the electronic cigarette in the dark, the position of the switching key can also be indicated, so at to facilitate users' smoking operation.

Figure 3:
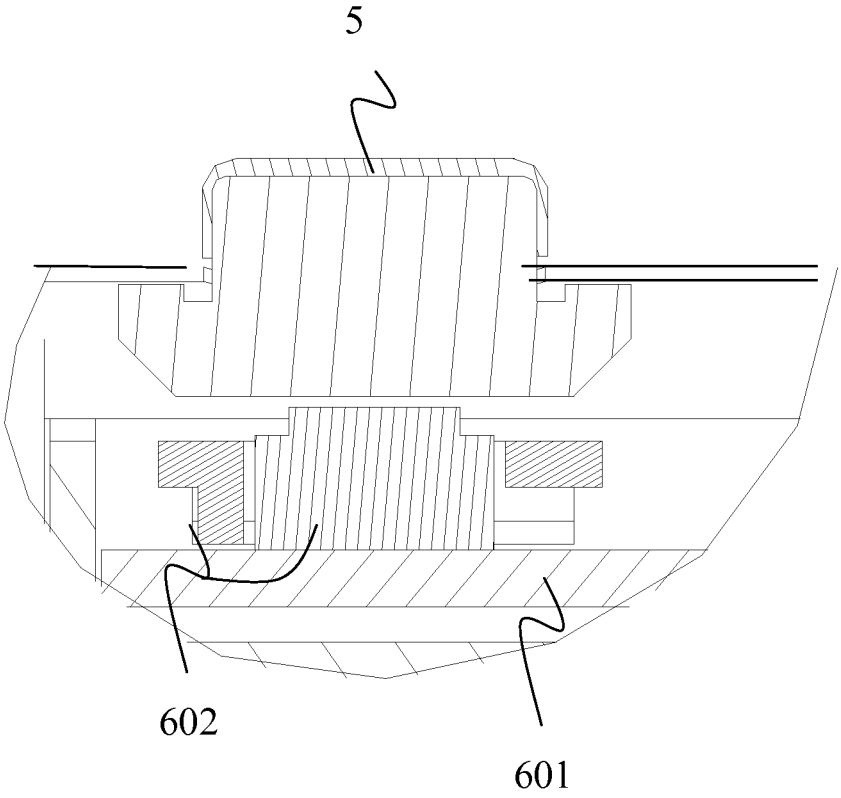
FIG. 3 illustrates a partially enlarged view of the electronic cigarette of FIG. 2.

Specifically, in the cigarette body of the electronic cigarette of this embodiment, along the direction away from the suction mouth lid 1, there successively houses the atomizing assembly 3, a switching controlling module 6 and the battery assembly 4. The switching controlling module 6 is fixed between the atomizing assembly 3 and the battery assembly 4. As shown in FIG. 3, the switching controlling module 6 comprises a PCB board 601 and a switching base 602. The switching key is pressed to contact or connect the switching base 602, the switching base 602 is configured for transmitting the press signal from the switching key to the PCB board 601, thus the PCB board 601 controls the electric connection between the atomizing assembly 3 and the battery assembly 4.

Further, the noctilucent material and/or fluorescent material can be provided on the surface of the switching key, such as being evenly coated on the switching key, or be attached on the switching key in granular phase. Understandably, the switching key can be directly made of the noctilucent material and/or fluorescent material. Specifically, the noctilucent material and/or fluorescent material may form figures or characters on the surface of the switching key, so as to add to the appearance of the electronic cigarette as well as to indicate the electronic cigarette and the position of the switching key.

Besides, the noctilucent material and/or fluorescent material may be configured around the switching on the cigarette body 2, such as being configured into a circle surrounding the switching key, so as to reduce the abrasion on the emitting material.

To prevent the noctilucent material and/or fluorescent material from abrasion because of the touch during the use of the electronic cigarette, a transparent layer, such as resin, can be coated on the noctilucent material and/or fluorescent material.

When the switching region 4 is touch sensing region, the above-mentioned structure of configuring the noctilucent material and/or fluorescent material on the switching key is also applicable.

Second Embodiment

Figure 5:
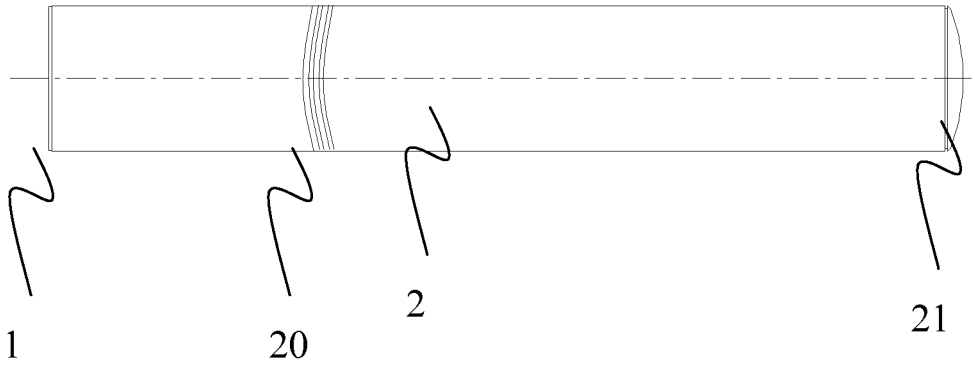
FIG. 5 illustrates a structure of electronic cigarette in accordance with the second preferable embodiment of the present application.

Referring to FIG. 5, similar with the first embodiment, the electronic cigarette of the second preferable embodiment, comprises a cigarette body 2, an end of the cigarette body 2 configures a suction mouth lid 1, and cigarette body 2 houses an atomizing assembly (not shown) and a battery assembly (not shown) electrically connected to the atomizing assembly, and with the supply from the battery assembly, the atomizing assembly can atomizing the smoke tar. Differently from the first embodiment, a plaster 20 is attached on an edge of outer surface of the cigarette body 2, and the noctilucent material or fluorescent material is configured on surface of the plaster 20.

The plaster 20 involves a layered structure, comprising a back glue layer and an emitting layer made of the emitting material on the back glue layer. The emitting layer can be formed by way of screen printing, steaming plating, splashing plating, coating or attaching. Understandably, the forming way of the emitting layer shall not be limited to what mentioned above. To obtain a better light emitting effect, the emitting layer is provided with a thickness of $10\text{-}2\times10^3$ μm, and in this embodiment, the thickness of the emitting layer is 1 mm.

Besides, to protect the emitting layer, a transparent layer for light transmission is configured on above of the emitting layer, herein the transparent layer is made of resin.

Similar with the first embodiment, the noctilucent material and/or fluorescent material in the emitting layer may form figures or characters in a very shape, so as to add to the appearance of the electronic cigarette as well as to indicate the electronic cigarette.

Third Embodiment

Figure 4:
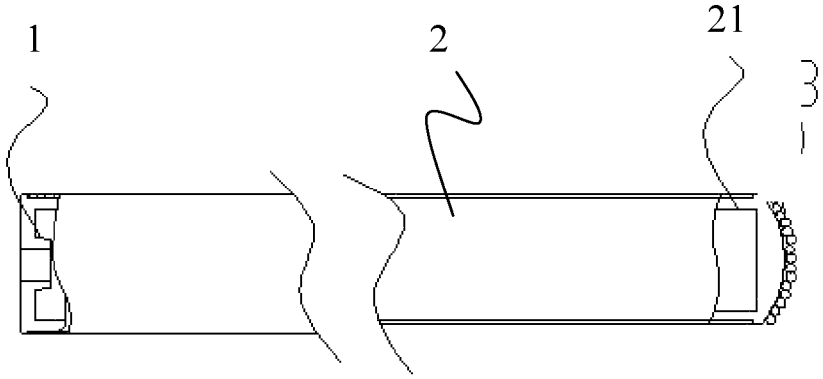
FIG. 4 illustrates a structure of electronic cigarette in accordance with the third preferable embodiment of the present application.

Referring to FIG. 4, similar with the first embodiment, the electronic cigarette of the third preferable embodiment, comprises a cigarette body 2 with a suction mouth lid 1 configured thereon. Specifically, the cigarette body 2 comprises an end, far away from the suction mouth lid 1, configuring a light cap 21, and thus the cigarette body 2 can be divided into a pipe body (not labeled) and the light cap 21, and the light cap is mounted on the end of the pipe body, far away from the suction mouth lid 1. The emitting material is configured on the surface of the light cap 21. Specifically, the light cap can be directly made of the emitting material.

Similarly with the structure of the plaster 20 of the second embodiment, the surface of the light cap 21 can also be provided with a layered emitting structure. For example, the emitting material can form a emitting layer on the light cap by way of screen printing, steaming plating, splashing plating, coating or attaching. By adding a adhere layer between the surface of light cap 21 and the emitting layer, the emitting layer can be steadily attached on the light cap 21. The adhere layer can be glue, double-sided adhesive or resin glue, etc.

To prevent the emitting layer form abrasion, a transparent layer used for light transmission is configured on above of the emitting layer, which can be configured for light transmission, and herein the transparent layer can be made of resin.

Besides, the emitting material can be fused or embedded into the surface of the light cap 21, and the specific way of fusion can be as follows: firstly adding a fusion agent on the light cap 21, and then with the effects of the fusion agent the emitting material can be fused into the light cap 21. Particularly, the emitting material in granular shape can be embedded into the light cap 21, and as shown in FIG. 4, the emitting material in granular shape is embedded into the surface of the light cap 21. Advantageously, a grain of the emitting material has a volume of 1.5 $mm^3$~150 $mm^3$. And the grains are irregularly arranged, and advantageously, the distance between adjacent grains is 0.5 mm~3 mm. Or directly using the way of heat fusion, i.e. firstly, heating the area of the light cap where the emitting material needs to be configured on, then attaching the emitting material onto the light cap 21.

The thickness of the emitting layer in this embodiment is as same as that in the third embodiment.

In this embodiment, the emitting material is configured on the light cap 21, therefore, the position of the electronic cigarette and the light cap can be indicated in the dark, and at the same time, it can simulate the situation of burning and lighting during real smoking.

Forth Embodiment

The electronic cigarette in this embodiment has similar structural features with the embodiments above that the electronic cigarette comprises a cigarette body 2 with a suction mouth lid 1 configured on an end of the body 2. The cigarette body 2 comprises a covering envelope on which several cystids for receiving the emitting material is formed outward. The emitting material is enveloped in the cystids. Understandably, in this means of envelope covering, the covering envelope should be transparent. The covering envelope is at least partly attached on the surface of the cigarette body 2.

The electronic cigarette in this embodiment may comprises the light cap and/or the switching controlling module and the switching region, and the covering envelope can be configured on the surface of the light cap. It should be understood that the structure of the electronic cigarette shall not be limited to what mentioned in the above mentioned embodiments, the emitting material can be configured on any position of the electronic cigarette, for example, the emitting material can be configured on the suction mouth lid 21, and to protect the user from absorbing the emitting material when smoking, the covering envelope in the forth embodiment can be attached onto the suction mouth lid, or the suction mouth lid can be designed to be long, in which case, the suction mouth lid can be divided into a suction part and a fixing part. The fixing part is close to the cigarette body the emitting material is configured on the fixing part, and the light transmission layer in the second embodiment can be added on the fixing part, thus on condition that the user smoking will not be effected, the position of the electronic cigarette can be indicated in the dark.

Above all, the electronic cigarette in the application, with the emitting material configured on the cigarette body, such as on the surface of the light cap, on the surface of the switching region, or on the cigarette body 2 surrounding the switching region, or with the plaster 20 comprising emitting material attached on the cigarette body, the electronic cigarette can emit light in the dark, and thus the user can reach the electronic cigarette exactly, and enjoy a better user experience.

While the present application has been described with reference to preferred embodiments, it will be understood by those skilled in the art that various changes may be made and equivalents may be substituted without departing from the scope of the present application. Thus, the present application will not be limited by the specific embodiments disclosed, but should include all the embodiments within the scope of the appended claims.

What is claimed is:

1. An electronic cigarette comprising a cigarette body, an atomizing assembly, a switching controlling module and a battery assembly; the atomizing assembly, the switching controlling module and the battery assembly being housed in the cigarette body; and wherein a switching key is defined on a surface of the cigarette body; emitting material being indicated the position of the switching key is configured on the cigarette body;

wherein the emitting material is a noctilucent material, which is configured around the switching key;

wherein the switching controlling module comprises a PCB board and a switching base; the switching key is pressed to contact or connect the switching base; the switching base is configured for transmitting a press signal from the switching key to the PCB board, thus the PCB board controls electric connection between the atomizing assembly and the battery assembly;

wherein a suction mouth lid is mounted at an end of the cigarette body, and the suction mouth lid contains a suction part and a fixing part; the fixing part is close to the cigarette body, emitting material is configured on the fixing part, and a light transmission layer is added on the emitting material of the fixing part;

wherein a light cap is made of emitting material and is mounted at the other end which is away from the suction mouth lid of the cigarette body;

wherein emitting material in granular shape is embedded into an outer surface of the light cap; an emitting layer is formed by the emitting material in granular shape;

wherein a grain of the emitting material in granular shape has a volume of 1.5 $mm^3$ to 150 $mm^3$, and distance between adjacent grains is 0.5 mm to 3 mm; and wherein a transparent layer used for light transmission is mounted on the emitting layer and the transparent layer is resin.

* * * * *